US005726614A

United States Patent [19]

Castonguay et al.

[11] Patent Number: 5,726,614

[45] Date of Patent: Mar. 10, 1998

[54] ELECTRONIC TRIP UNIT CONVERSION KIT FOR HIGH AMPERE-RATED CIRCUIT BREAKERS

[75] Inventors: Roger N. Castonguay, Terryville; Jeffrey D. Lord, Unionville, both of Conn.

[73] Assignee: General Electric Company, New York, N.Y.

[21] Appl. No.: 653,595

[22] Filed: May 24, 1996

[51] Int. Cl.[6] ..... H01H 9/00

[52] U.S. Cl. ..... 335/177; 335/179

[58] Field of Search ..... 335/177–179

[56] References Cited

U.S. PATENT DOCUMENTS 3,073,936 1/1963 Baird .

3,142,784 7/1964 Bloomfield ..... 335/179

3,761,778 9/1973 Willard .

4,239,439 12/1980 Nemoto ..... 335/177

4,672,501 6/1987 Bilac et al. .

*Primary Examiner*—Lincoln Donovan

*Attorney, Agent, or Firm*—Richard A. Menelly; Carl B. Horton

[57] ABSTRACT

A field-installable circuit breaker trip actuator unit includes a flux shifter unit that interfaces with the circuit breaker operating mechanism and is installable without dismantling the circuit breaker components. The flux shifter unit responds to an electronic trip unit to articulate the circuit breaker operating mechanism and separate the circuit breaker contacts upon occurrence of an overcurrent condition. A reset arrangement allows the trip actuator unit to be automatically reset upon completion of the contact separation process.

14 Claims, 3 Drawing Sheets

ELECTRONIC TRIP UNIT CONVERSION KIT FOR HIGH AMPERE-RATED CIRCUIT BREAKERS

BACKGROUND OF THE INVENTION

High ampere-rated circuit breakers such as described within U.S. Pat. No. 3,073,936 entitled "Electric Circuit Interrupter" are currently employed within industrial manufacturing facilities to protect the electric equipment and buildings from damage due to overcurrent conditions within the electrical distribution system. Earlier manufactured circuit breakers employed thermal-magnetic trip units to determine overcurrent conditions and to articulate the circuit breaker operating mechanism to separate the circuit breaker contacts to interrupt the associated electric circuit. Later manufactured circuit breakers employed electronic trip units which contained so-called "flux shifters" to articulate the operating mechanism upon signal from the electronic trip unit. One example of an early electronic trip unit is found in U.S. Pat. No. 3,761,778 entitled "Static Trip Control Unit for Electric Circuit Breaker".

Such robust circuit breakers remain in operation to this date without needing replacement or repair. However, state of the art digital trip units of the type described within U.S. Pat. No. 4,672,501 entitled "Circuit Interrupter and Controller Unit", provide more reliable protection by better control over the circuit interruption time and current parameters. It would be economically advantageous to incorporate state of the art digital trip units within existing circuit breakers without having to dismantle the circuit breaker operating components in the process.

One purpose of the invention, accordingly, is to provide a conversion unit that will incorporate digital trip units within existing circuit breakers without having to dismantle the circuit breaker operating components.

SUMMARY OF THE INVENTION

In accordance with the invention, an electronic trip unit conversion kit includes a flux shifter and reset arrangement to articulate the circuit breaker operating mechanism upon the occurrence of an overcurrent condition to separate the circuit breaker contacts and to reset the flux shifter after the circuit breaker contacts have become separated.

DESCRIPTION OF THE PREFERRED EMBODIMENT

Figure 1:
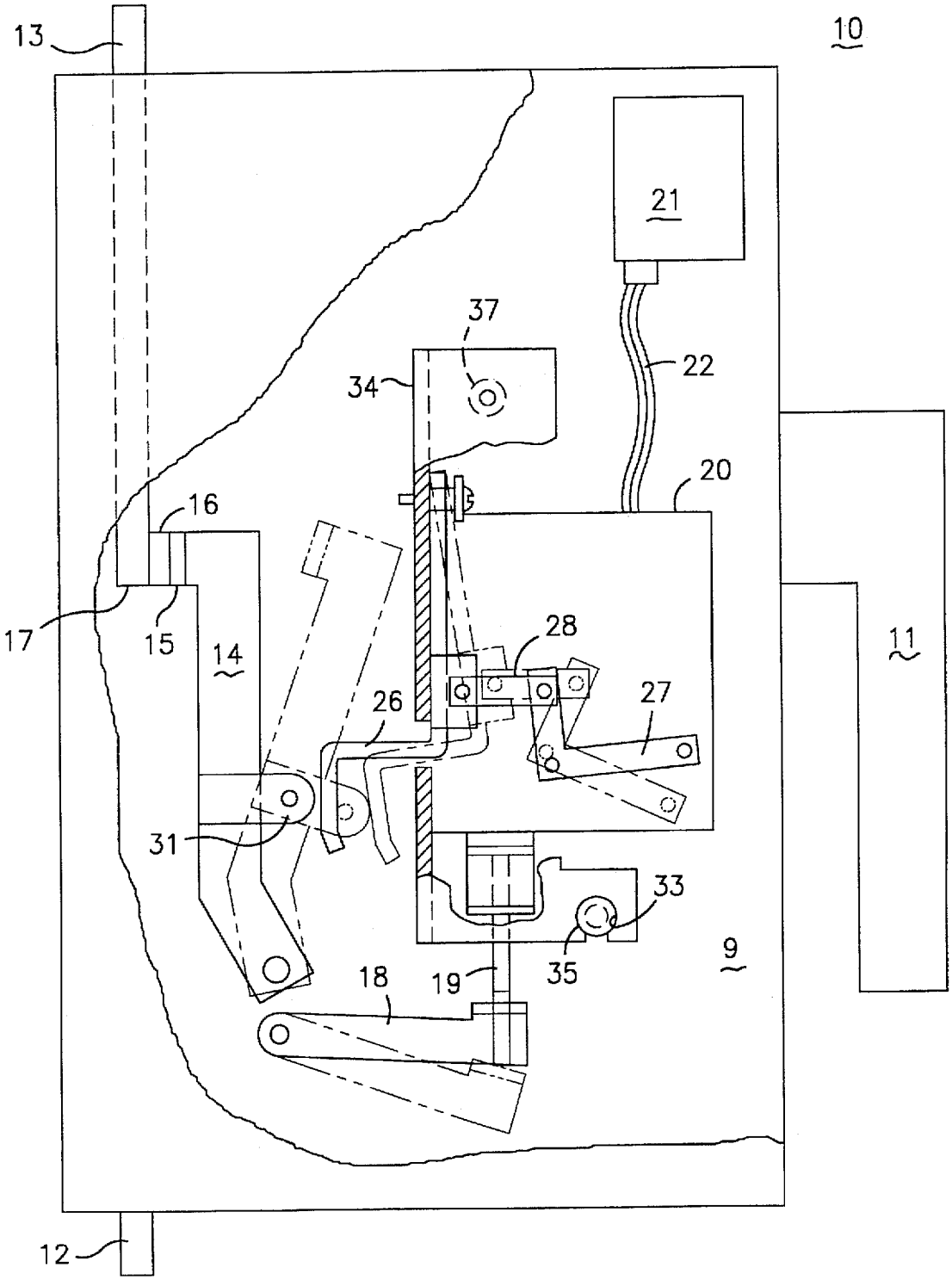
FIG. 1 is a side view of a circuit breaker with a part of the case removed to depict the circuit breaker contact arms, contacts and associated trip actuator in accordance with the invention.

FIG. 1 shows an industrial-rated circuit breaker 10, such as described in aforementioned U.S. Pat. No. 3,073,936, with an operating handle 11 extending from the front with load straps 12 and line straps 13 arranged at opposite ends thereof. The movable contacts 15 at one end of the movable contact arm 14 and the fixed contacts 16 on the contact support 17 are shown in solid lines in the CLOSED condition and in phantom lines in the OPEN condition. As described in the aforementioned U.S. Pat. No. 3,073,936, the condition of the contacts are controlled by an operating mechanism (not shown) that is restrained from articulation by means of a trip latch 18. According to the invention, a trip unit conversion kit 9, which includes a trip actuator unit 20, is attached to the interior of the circuit breaker by means of a U-shaped slot 33 within the support bracket 34, headed bushing 35 and screws 36, 37. The headed bushing is an important feature of the invention as it facilitates positioning and mounting of the bracket to the circuit breaker operating mechanism support frame after the components are completely assembled to the bracket to complete the trip unit conversion kit 9. The headed bushing 35 is next attached to the operating mechanism support frame and the shank 50 is sized to accept and capture the thickness of the slot 33 as indicated at 49. The support bracket 34 is attached to the top part of the circuit breaker operating mechanism support frame by means of the screw 37. The trip actuator interacts with the circuit breaker cross bar 31 and trip latch 18 in the following manner. Upon receipt of a trip signal from the trip unit 21, over conductor 22, the flux shift unit 51 on the trip actuator unit 20 releases the trip plunger 19 which strikes the trip latch 18 and rotates the trip latch to the tripped position shown in phantom allowing the operating mechanism to separate the contacts 15, 16 as described in the aforementioned U.S. Pat. No. 3,073,396.

Figure 2:
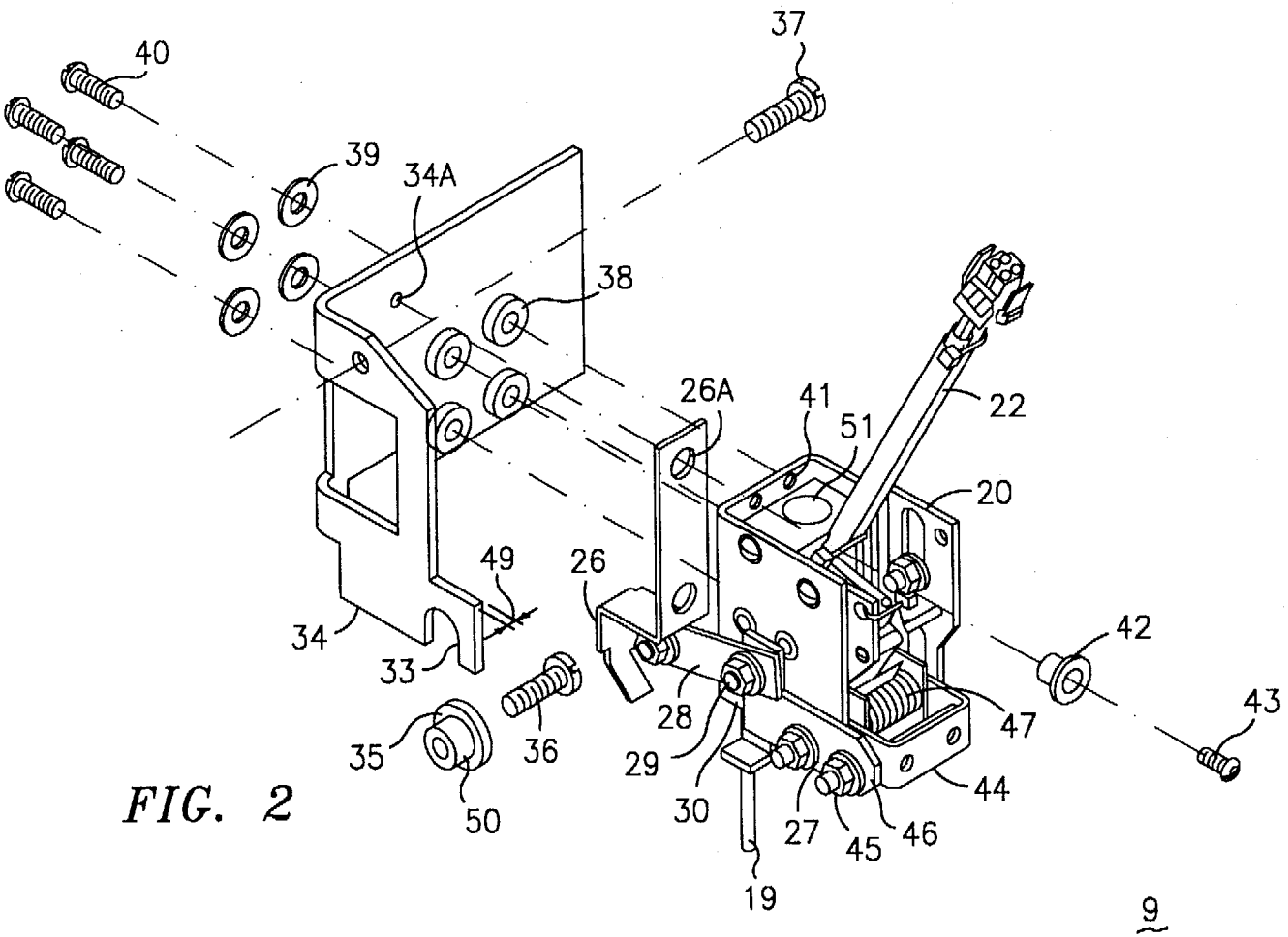
FIG. 2 is an enlarged top perspective view of the components of the trip actuator of FIG. 1.
Figure 3:
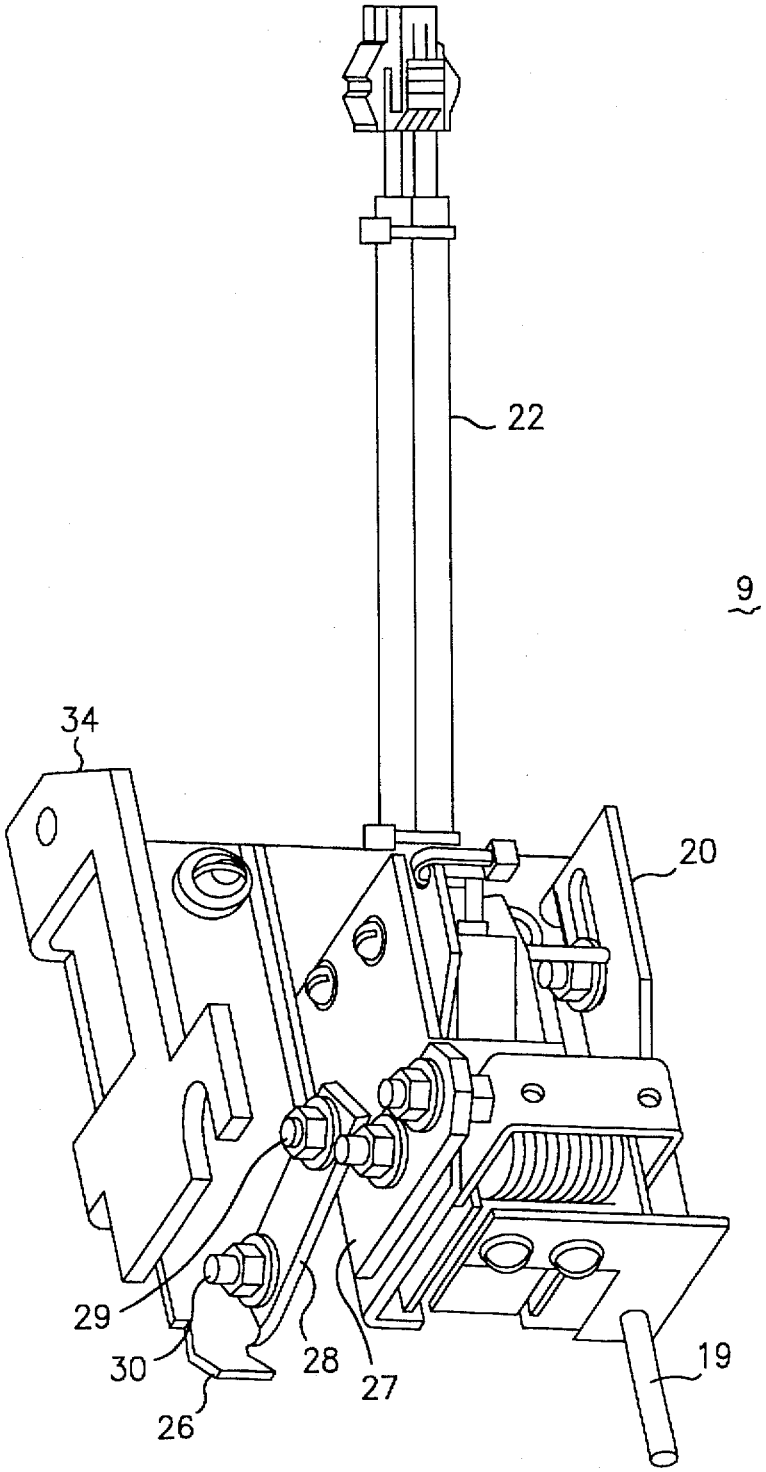
FIG. 3 is an enlarged top perspective view of the trip actuator of FIG. 2 with the components completely assembled.

As best seen by referring jointly to FIGS. 1–3, the reset paddle 26 is attached to a reset arm 27 on the trip actuator 20 by a connector link 28, screws 29 and nuts 30. The reset paddle 26 interacts with the circuit breaker cross bar 31 to reset the trip actuator unit 20, as shown in phantom, in the manner described in the aforementioned U.S. patent. application Ser. No. 08/551,640 as soon as the circuit breaker contacts have separated. The trip actuator unit 20 is attached to the support bracket 34 via rubber grommets 38, washers 39, screws 40, and threaded apertures 41. The use of rubber grommets substantially prevents the physical shock and vibration generated within the circuit breaker from affecting the trip actuator unit 20 and is an important feature of the invention. The reset paddle 26 is connected to the support bracket 34 using a pivot bushing 42 offset from the aperture 26A in the reset paddle 26 and is fastened to the support bracket 34 by means of the screw 43 and the threaded aperture 34A. The reset arm 27 is attached to the flux shifter unit reset bracket 44 contained within the trip actuator unit 20 by means of screws 45 and nuts 46. The position of the flux shifter reset bracket 44 is determined by the reset spring 47 in a manner described in the aforementioned U.S. patent application Ser. No. 08/1551,640. Upon displacement of the reset paddle 26 by the circuit breaker crossbar 31, the reset arm 27 rotates flux shifter reset bracket 44 against the return bias of the flux shifter return spring 47 to return the plunger 19 to the initial reset position as shown in solid lines.

A trip unit conversion kit with means for automatically resetting the flux shift unit has been described herein. The conversion kit provides electronic trip facility to high ampere rated circuit breakers by on-site field installation.

What is claimed is:

1. A circuit breaker trip unit conversion kit comprising:

a trip actuator unit responsive to a trip initiating signal from a circuit breaker trip unit to articulate a circuit breaker operating mechanism and separate a pair of circuit breaker contacts, said trip actuator unit including a flux shift unit having a flux shift plunger;

a reset arm pivotally arranged on said trip actuator unit and connecting with said flux shift plunger; and a connector link attached to a reset paddle by means of a connector link at one end and arranged for interacting with a circuit breaker cross bar at an opposite end, whereby said cross bar motivates said reset paddle and said reset arm for resetting said flux shift plunger upon separation of said circuit breaker contacts.

2. The trip unit conversion kit of claim 1 including a support bracket for supporting said flux shift unit and connecting said trip actuator unit within a circuit breaker interior.

3. The trip unit conversion kit of claim 2 wherein said support bracket comprises an L-shaped configuration, one end of said L being connected with a circuit breaker interior and an opposite end of said L being connected with said trip actuator unit.

4. The trip unit conversion kit of claim 1 including a connector link connecting between said reset paddle and said reset arm.

5. The trip unit conversion kit of claim 4 wherein said reset paddle is pivotally-connected to said support bracket at one end and is pivotally-connected to said connector link at an opposite end.

6. The trip unit conversion kit of claim 5 wherein said reset bracket is attached to said support bracket by a pivot bushing.

7. The trip unit conversion kit of claim 2 wherein said support bracket includes a shaped mounting slot on a bottom thereof for receiving a headed bushing upon attachment of said support bracket to a circuit breaker interior.

8. A circuit breaker comprising:

an enclosure;

a pair of contacts within said enclosure arranged for interrupting circuit current on command;

a trip actuator unit responsive to a trip initiating signal from a circuit breaker trip unit to articulate a circuit breaker operating mechanism and separate said circuit breaker contacts, said trip actuator unit including a flux shift unit having a flux shift plunger;

a reset arm pivotally arranged on said trip actuator unit and connecting with said flux shift plunger; and a connector link attached to a reset paddle by means of a connector link at one end and arranged for interacting with a circuit breaker cross bar at an opposite end, whereby said cross bar motivates said reset paddle and said reset arm for resetting said flux shift plunger upon separation of said circuit breaker contacts.

9. The circuit breaker of claim 8 including a support bracket for supporting said flux shift unit and connecting said trip actuator unit within a circuit breaker interior.

10. The circuit breaker of claim 8 wherein said support bracket comprises an L-shaped configuration, one end of said L being connected with a circuit breaker interior and an opposite end of said L being connected with said trip actuator unit.

11. The circuit breaker of claim 8 including a connector link connecting between said reset paddle and said reset arm.

12. The circuit breaker of claim 8 wherein said reset paddle is pivotally-connected to said support bracket at one end and is pivotally-connected to said connector link at an opposite end.

13. The circuit breaker of claim 8 wherein said reset bracket is attached to said support bracket by a pivot bushing.

14. The circuit breaker of claim 9 wherein said support bracket includes a U-shaped mounting slot on a bottom thereof for receiving a headed bushing upon attachment of said support bracket to a circuit breaker interior.

* * * * *